United States Patent [19]

Wildschut

[11] 4,008,932

[45] Feb. 22, 1977

[54] STRUCTURAL ELEMENT

[75] Inventor: Jan H. Wildschut, Zeist, Netherlands

[73] Assignee: Stamicarbon B.V., Geleen, Netherlands

[22] Filed: Sept. 24, 1974

[21] Appl. No.: 509,024

[30] Foreign Application Priority Data

Oct. 2, 1973 Netherlands ..... 7313505

[52] U.S. Cl. ..... 312/198; 46/25; 52/608; 211/194

[51] Int. Cl.[2] ..... A47B 53/00

[58] Field of Search ..... 229/8, DIG. 9; 46/25, 46/1 L, 23, 16, 17, 28; 52/609, DIG. 10, 608, 593, 594; 273/157, 160; 35/72; 312/198; 211/194

[56] References Cited

UNITED STATES PATENTS

| | | | |
|---|---|---|---|
| 1,734,954 | 11/1929 | Arvidson | 52/DIG. 10 |
| 1,997,022 | 4/1935 | Stalker | 46/1 L |
| 2,440,836 | 5/1948 | Turngren | 46/25 |
| 3,010,888 | 11/1961 | Battle | 52/608 |
| 3,303,604 | 2/1967 | Mote | 46/25 |
| 3,462,062 | 8/1969 | Miller | 46/25 |
| 3,787,996 | 1/1974 | Smith | 46/25 |

FOREIGN PATENTS OR APPLICATIONS

| | | | |
|---|---|---|---|
| 539,084 | 6/1922 | France | 52/608 |

*Primary Examiner*—John E. Murtagh
*Attorney, Agent, or Firm*—Cushman, Darby & Cushman

[57] ABSTRACT

A structural element for the assembly of structures of furniture is described having a regular hexagonal flat bottom and flat walls installed along the circumference of this bottom and positioned at a right angle thereto, which walls, at the angular points of the bottom, have their side edges adjoining. The upstanding ribs formed do not have the same length but after a short rib follows a long one. The difference in length is equal to half the length of a side of the hexagonal bottom. The element is preferably made of synthetic material.

4 Claims, 11 Drawing Figures

STRUCTURAL ELEMENT

Figure 1:
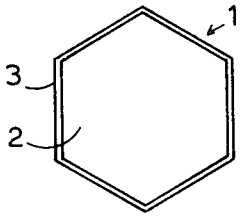

The invention relates to a structural element for the assembly of structures for furnishing houses, exhibition rooms and the like, consisting or a polygonal, flat bottom and flat walls installed along the circumference of this bottom and positioned at a right angle thereto, which walls, at the angular points of the bottom, have their side edges adjoining.

As a rule, the known elements of this kind have a rectangular bottom and vertical walls of identical height, so that they can be placed side by side or on top of each other for the assembly of a structure. In this type of structures, in the case of adjacent elements, only one face of the one element touches the other element which limits the number of possibilities as regards the assembly of structures from similar elements.

The invention provides a structural element which can be so combined with other elements that two faces of the one element may mate with the top edge of the vertical walls of another element.

This has been achieved in that according to the invention the bottom has the form of a regular hexagon and the vertical walls have the form of a rectangular trapezium whose difference in length between the long and the short parallel side is equal to half length of the sides of the hexagonal bottom, which walls are so installed that successive walls, at the angular points of the bottom, are adjoining with sides of equal length.

As a result of this shaping, equal elements may be relatively arranged in the following manner:

a. with the vertical walls against each other. The elements are then arranged in a hexagonal formation b. with the vertical walls in line, in such a way that a long rib of the one element lies on the extension of a short rib of the other element c. with the bottoms against each other, in such a way that the two hexagons cover each other d. with the bottom at right angles, in such a way that two adjacent walls of the one element fit in the angle formed between the end edges of two vertical walls of the other elements.

Because the difference between the long and the short parallel sides of the vertical walls is equal to half the side of the hexagonal bottom, the angle between the end edges of two adjacent walls is equal to the angle formed by these walls. This makes it possible to continue the structure, transversely to a rib of an element, in a direction parallel to the bisector of the angle enclosed by two walls. Starting from an element the structure may also be continued — apart from a direction at a right angle to the bottom or to the side walls — in a direction at an angle of 120° to a side wall. The bottoms of two mating elements relatively form a straight angle in this transverse stacking, so that by combination of a number of elements a stable, three-dimensional structure can be assembled in an aesthetically justified way.

In this transverse stacking elements can be combined in two different ways. In the one case one long side of the one element is located in the angle formed between two edges of the other element. These edges then run parallel with the end edges of the one element. In the second case the one element lies with one short side in the angle formed between two edges of the other element. The end edges of the mating elements are then relatively positioned at an angle of 60°.

The short parallel side of the vertical walls is preferably equal to or larger than half the side of the hexagonal bottom. In the transverse stacking according to the second of the ways mentioned above, the angular point of the angle formed between the end edges of the one element will then invariably be located on the short side of the other element, so that no openings are present which may be detrimental to the appearance of the structure. If the short sides are equal to half the length of the sides of the hexagonal bottom, the angular point of the angle between the end edges of the one element will just coincide with the angular point of this angle of the other element. The flanks of the other element extending beyond the one element then have the form of an equilateral triangle whose side is as long as the side of the hexagonal bottom.

The invention will be elucidated in more detail on the basis of the modes of realization given in the drawing.

Figure 2:
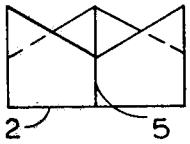

FIG. 1 gives a top view of a structural element according to the invention;

FIG. 2 gives a front view of this element, and

Figure 3:
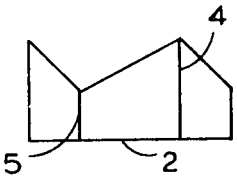

FIG. 3 a side-view thereof

Figure 4:
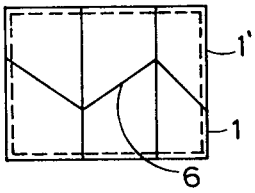

FIG. 4 shows two elements stacked on top of each other

Figure 7:
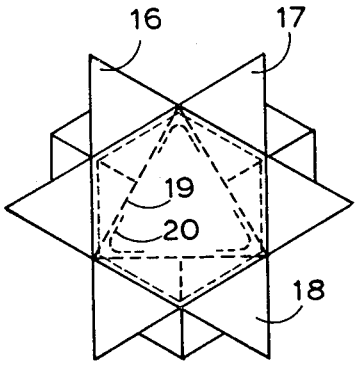
Figure 8:
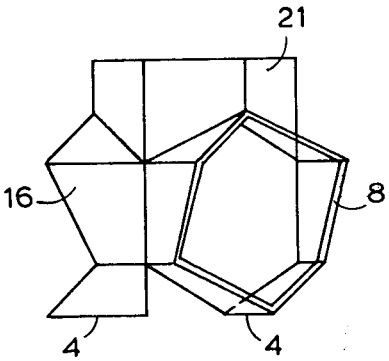
Figure 9:
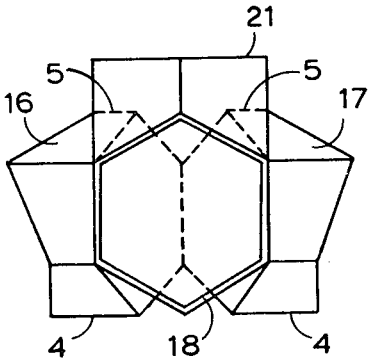
Figure 5:
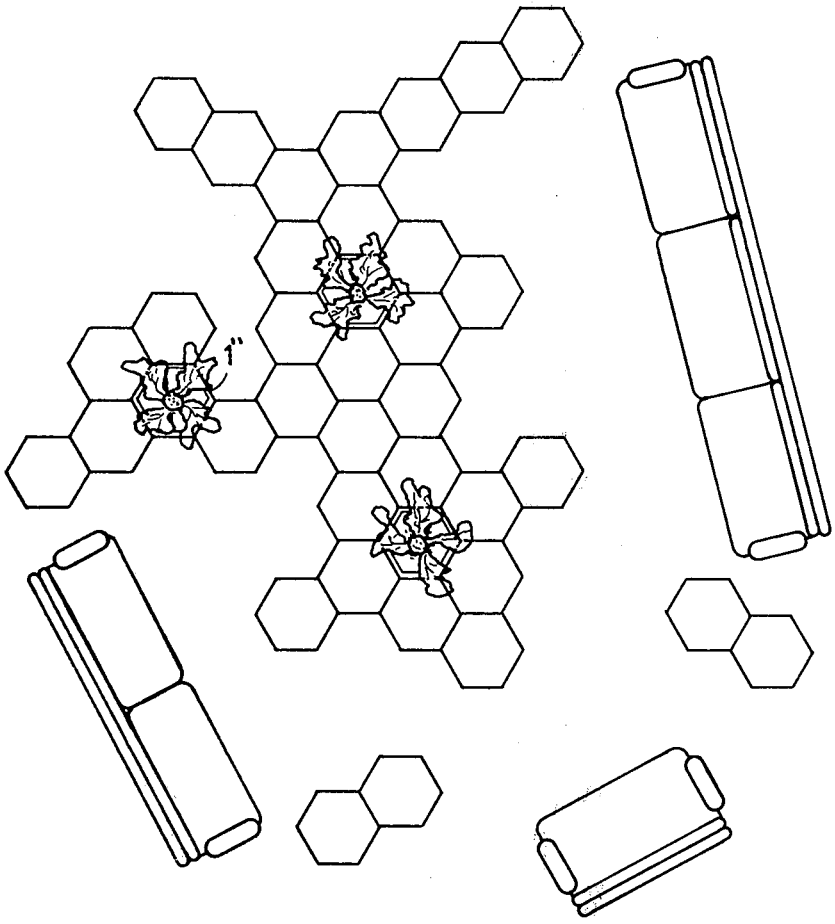
Figure 6:
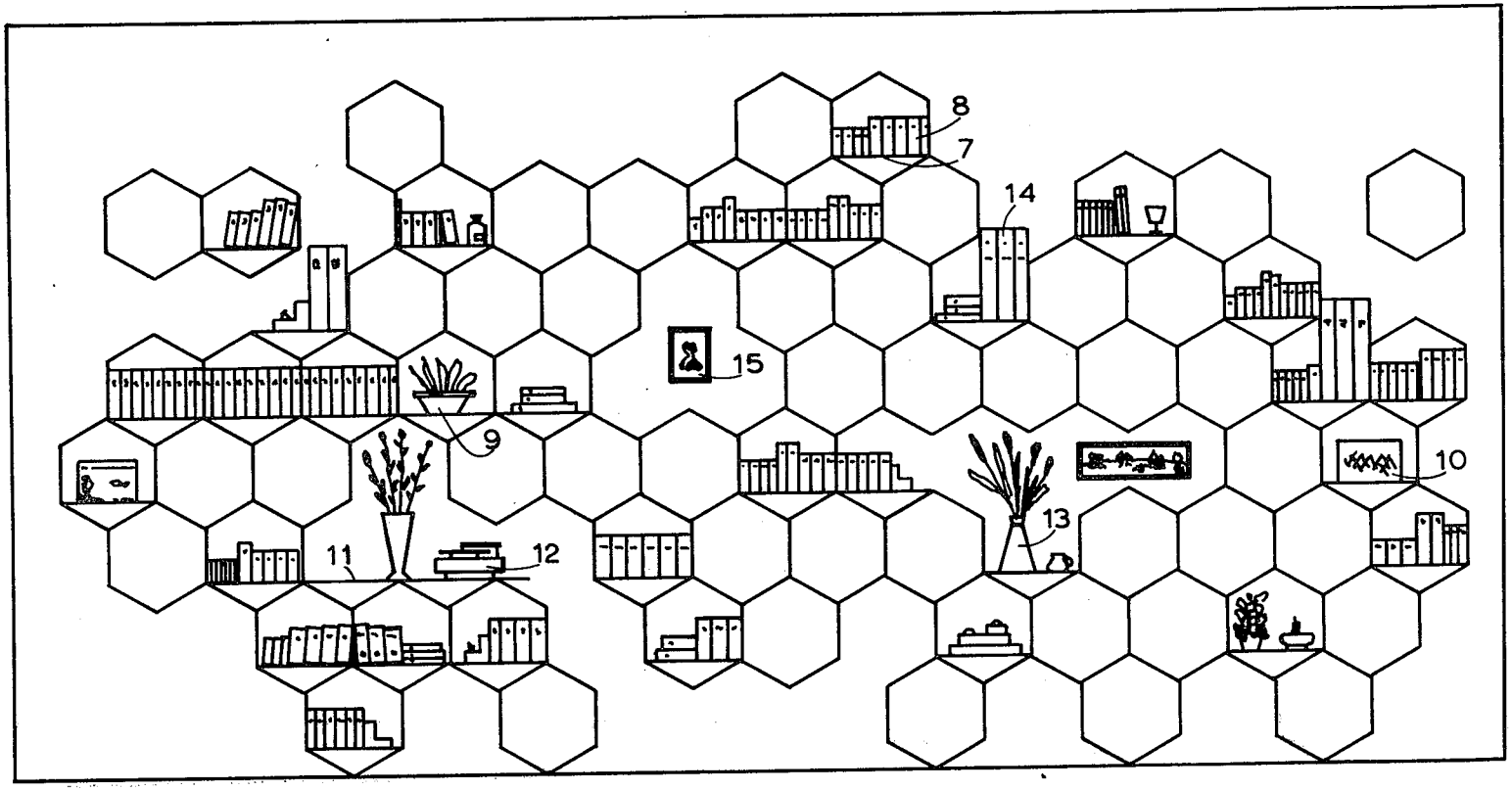
Figure 10:
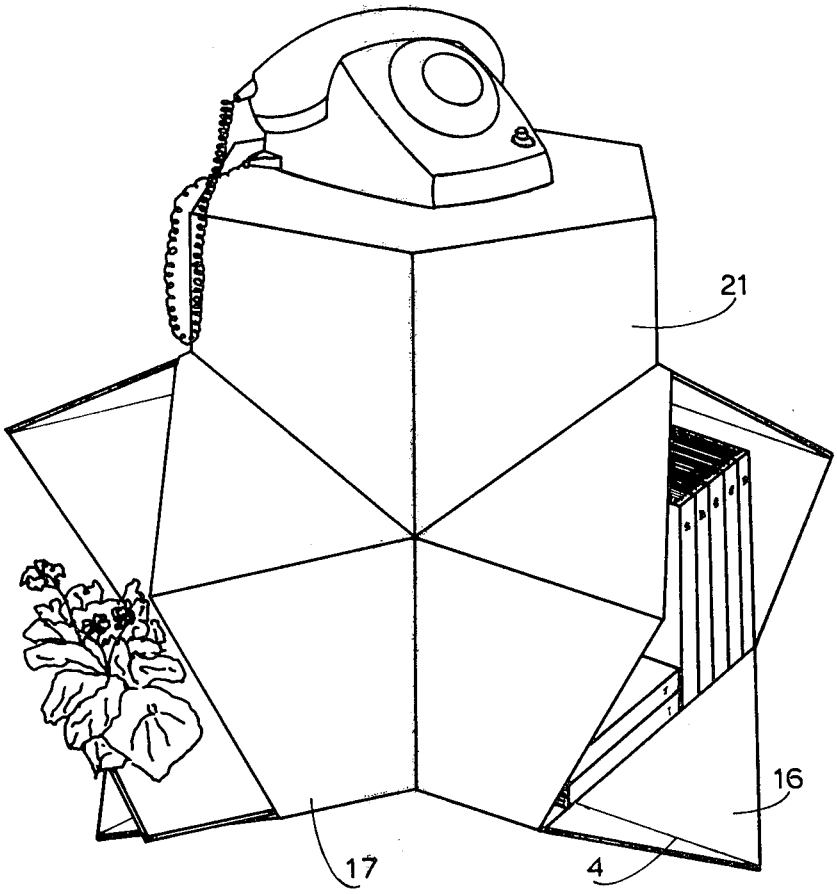

FIG. 5 shows a number of elements whose side walls are placed against each other, these elements being combined into a cocktail unit FIG. 6 shows a number of elements whose side walls are placed against each other, these elements being combined to form a piece of wall furniture FIG. 7 gives a top view of a table with storage compartments consisting of four elements transversely stacked on top of each other FIG. 8 gives a side-view of this piece of furniture, and FIG. 9 a front view FIG. 10 gives a perspective view of the piece of furniture shown in the FIGS. 7–9, and FIG. 11 gives a perspective view of this piece of furniture with a modified arrangement of the elements.

The structural element 1 consists of a bottom 2 having the form of a regular hexagon and six vertical walls 3. The vertical walls are placed along the circumference of the hexagonal bottom and have the form of a rectangular trapezium. The difference in length between the long sides 4 and the short sides 5 of the trapezia is equal to half the side of the hexagonal bottom. In the embodiments shown in the drawing the long, parallel side is as long as the side of the hexagon. The walls are so installed that the long, parallel sides of two adjoining walls coincide, as well as the short sides (FIG. 1–3).

In the example embodiment according to FIG. 4 two elements 1 and 1' are placed on top of each other with the walls in line. The bottom of the element 1' is at the top side, so that the fit of the walls has the shape of a saw tooth and a box-like structure having a hexagonal cross section is obtained. The edges fitting together can be suitably connected, for instance by means of a snap joint. It is also possible for two edges 6 which are placed against one another to be connected with a hinge, so that a box is obtained with a hinged cover 1'. The lower part 1 of this box may then be divided into compartments, for storage of various objects.

In the example embodiment according to FIG. 5 a number of elements is combined into a so-called cocktail unit. The elements connect with each other by the trapezium-shaped side walls. The elements serving as table are in a position in which the bottom is pointing upwards. They may then directly rest on the floor by the three end-points of the long trapezium sides or by means of a central column. This column may, for instance, be provided at the two ends with a tripod, one fitting into the hexagonal element and the other resting on the floor. The table furniture may be given a terraced structure by application of columns of different heights or adjustable lengths. A number of elements may be arranged with their bottoms pointing downwards, so that they can be used as trays for plants 1'', terrariums, bottle trays, etc.

FIG. 6 shows an example embodiment in which the elements are applied for the assembly of a piece of wall furniture. The bottom of the elements is fitted to the wall, with the aid of hooks or screws, in such a position that two opposite side walls are in a vertical position. In a number of elements horizontal shelves 7 are installed for supporting books 8, flower pots 9, loudspeakers 10, etc. These shelves may be loosely slid into the elements or be fastened thereto by means of brackets. For this purpose also elements may be applied in which the shelves form one whole with the element. To the top angular points of a number of elements placed side by side also long shelf 11 may be applied for supporting long objects, such as radios, automatic record-players 12, etc. The elements are placed in a hexagonal formation, in which local elements may have been omitted from an easthetic point of view and in order to accommodate large objects, like flower-vases 13 and high books 14, or wall decorations 15.

The elements may also be given such a position that two opposite sides are in horizontal position. By installation of one central horizontal shelf in the elements, the elements contain two supporting surfaces for accommodation of objects, whilst, in some cases, also the upper surface can be utilized.

In the example embodiment according to the FIGS. 7–10 three elements 16, 17 and 18 are so arranged that one long rib 4 is resting on the floor. The bottoms are facing each other and connect with one another by a side edge, so that in top view they form an equilateral triangle 19. At the top side of the elements there is a short rib 5. The elements may be fastened together with the aid of strips 20, which are connected with the elements with bolts or a snap joint.

On the elements a fourth element 21 is placed in such a way that the bottom is pointing upwards and that the angles between adjoining end edges fit to the two top of each of the elements 16, 17 and 18. The three side compartments of the lower elements can be utilized for storage of books, bottles, etc. and the upper compartment of element 21 for tabletop, as is shown in FIG. 10. Further, supporting ribs may be installed in the elements in order to oppose deflection of the book shelves.

Figure 11:
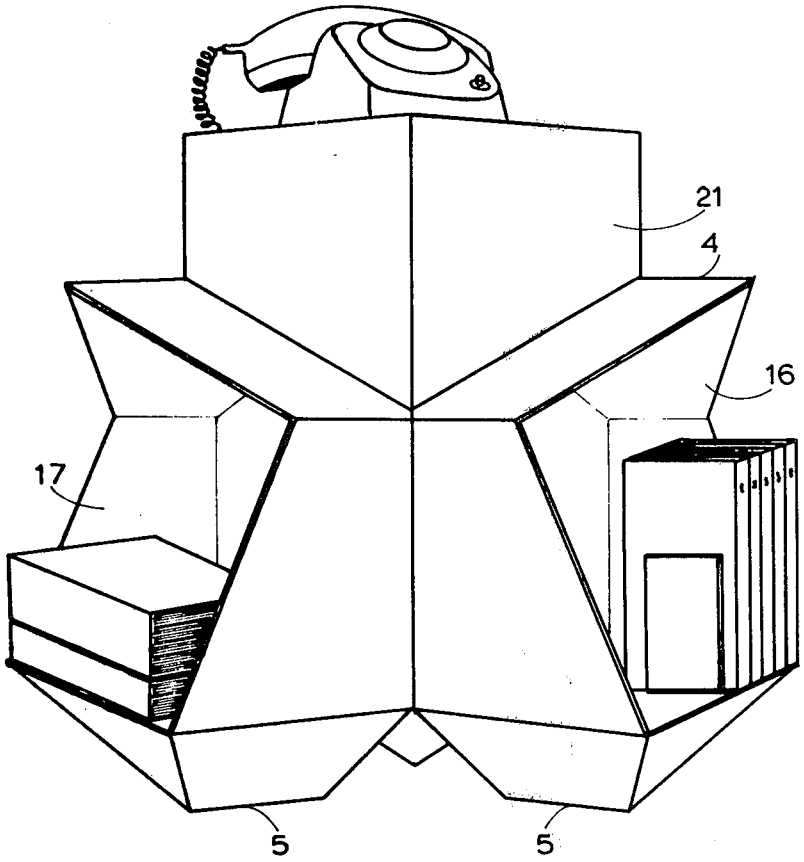

The elements 16, 17 and 18 may also be so arranged that they rest on the floor with a short rib 5. In this case the lower edge of the element 21 is parallel to the end edges of the lower elements (FIG. 11).

On element 21 a subsequent element may be placed in such a way that the bottoms cover each other, whereupon, in a similar way as in the FIGS. 6–11, three elements are installed in a triangular arrangement which are roofed over by an element placed horizontally, and so on, until a structure is obtained having the form of a totem pole, which structure may extend from the floor to the ceiling of a room. The triangles 19 of subsequent layers may then be relatively turned through an angle of 60° each time.

The elements are preferably made of a thermoplastic by injection-moulding, vacuum-forming, or compression. Also a flat development of the bottom and the walls may be made, in which the connection between the bottom and the walls is kept thin, so that the walls may be hinging round these places relative to the bottom to enable their being raised.

ABS is a very suitable plastic because of its good mechanical properties and its attractive appearance. However, also other plastics may be applied, such as polyethylene, polypropylene, impact-resistant polystyrene, polyvinylchloride, polycaprolactam, etc. If necessary, the plastics may be reinforced, for instance with glass fibres. The elements may be made, in any colour required, of opaque, translucent, and transparent material. The surface of the elements may be glossy or matted.

Apart from the application in house furnishing already described, the elements according to the invention may be applied in the assembly of dividing walls in office rooms, stands at exhibitions and fairs, storage compartments for bottles and the like in shops, etc. The elements may then be divided into compartments to accommodate the objects to be stored.

I claim:

1. Structure assembled of structural elements in which each of said structural elements consists of a polygonal, flat bottom and flat walls installed along the circumference of this bottom and positioned at a right angle thereto, which walls, at the angular points of the bottom, have their side edges adjoining, the structural element being characterized in that the bottom has the form of a regular hexagon and the vertical walls have the form of a rectangular trapezium whose difference in length between the long and the short parallel side is equal to half the length of the sides of the hexagonal bottom, which walls are so arranged that successive walls are adjoining with sides of equal length at the angular points of the bottom.

2. The structure of claim 1, characterized in that the short parallel side of the vertical walls, of each of said structural elements, is longer than, half the side of the hexagonal bottom.

3. The structure of claim 1, characterized in that the short parallel side of the vertical walls, of each of said structural elements, is equal to the half the side of the hexagonal bottom.

4. The structure of claim 1, wherein the base of each of the trapezium forming vertical walls, of each of said structural elements, is coextensive with a side of the regular hexagon.

* * * * *